US010569924B2

(12) United States Patent
Jarman et al.

(10) Patent No.: US 10,569,924 B2
(45) Date of Patent: Feb. 25, 2020

(54) LIGHTWEIGHT POLYMERIC CONTAINER FINISH

(71) Applicant: AMCOR RIGID PLASTICS USA, LLC, Wilmington, DE (US)

(72) Inventors: Jonathan P. Jarman, Ann Arbor, MI (US); Luke A. Mast, Brooklyn, MI (US)

(73) Assignee: AMCOR RIGID PLASTICS USA, LLC, Wilmington, DE (US)

( * ) Notice: Subject to any disclaimer, the term of this patent is extended or adjusted under 35 U.S.C. 154(b) by 0 days.

(21) Appl. No.: 15/763,778

(22) PCT Filed: Mar. 31, 2017

(86) PCT No.: PCT/US2017/025399
§ 371 (c)(1),
(2) Date: Mar. 27, 2018

(87) PCT Pub. No.: WO2018/075093
PCT Pub. Date: Apr. 26, 2018

(65) Prior Publication Data

US 2019/0047739 A1 Feb. 14, 2019

Related U.S. Application Data

(60) Provisional application No. 62/411,029, filed on Oct. 21, 2016.

(51) Int. Cl.
*B65D 41/34* (2006.01)
*B65D 1/02* (2006.01)
*B65D 85/72* (2006.01)

(52) U.S. Cl.
CPC ..... *B65D 1/0246* (2013.01); *B65D 1/023* (2013.01); *B65D 1/0207* (2013.01);
(Continued)

(58) Field of Classification Search
CPC ..... B65D 1/023; B65D 85/72; B65D 1/0207; B65D 1/0246; B65D 41/3428
See application file for complete search history.

(56) References Cited

U.S. PATENT DOCUMENTS 6,089,390 A 7/2000 Druitt et al.
9,359,099 B2 6/2016 Zoppas et al.
(Continued)

FOREIGN PATENT DOCUMENTS

DE 202007009983 U1 10/2007
EP 1072528 A1 1/2001
(Continued)

OTHER PUBLICATIONS

Supplementary European Search Report dated May 10, 2019 issued in corresponding European patent application No. 178576559 (8 pages).
(Continued)

*Primary Examiner* — Stephen J Castellano
(74) *Attorney, Agent, or Firm* — Harness, Dickey & Pierce, P.L.C.

(57) ABSTRACT

A polymeric container including a base, a body, a finish, finish threads, and a tamper lip. The body extends from the base. The finish defines an opening through which a product can pass into, and out of, an internal volume of the container defined at least in part by the body. The finish threads are at an outer surface of the finish, and are configured to cooperate with closure threads of a closure to secure the closure to the finish. The tamper lip extends from the outer surface of the finish, and is configured to replace the support flange during handling, and to cooperate with a tamper tab of the closure. The closure diameter is about the same as the neck diameter.

17 Claims, 8 Drawing Sheets

(52) U.S. Cl.
CPC ..... *B65D 41/3428* (2013.01); *B65D 85/72* (2013.01); *B65D 2501/0081* (2013.01)

(56) References Cited

U.S. PATENT DOCUMENTS

| | | | | |
|---|---|---|---|---|
| 2008/0257849 | A1 | 10/2008 | Farrar et al. | |
| 2009/0008360 | A1 | 1/2009 | Piccioli et al. | |
| 2009/0078668 | A1 | 3/2009 | Kraft | |
| 2009/0283492 | A1 | 11/2009 | Molinaro et al. | |
| 2010/0089863 | A1* | 4/2010 | Matsuoka | B65D 1/023 215/252 |
| 2010/0270256 | A1 | 10/2010 | Penny | |
| 2011/0278313 | A1 | 11/2011 | Labadie et al. | |
| 2015/0202818 | A1* | 7/2015 | Marin | B29B 11/14 428/36.92 |
| 2016/0001913 | A1 | 1/2016 | Koenig | |
| 2017/0210503 | A1* | 7/2017 | de Cleir | B65D 1/023 |

FOREIGN PATENT DOCUMENTS

| | | | |
|---|---|---|---|
| WO | 2005097453 | A1 | 10/2005 |
| WO | WO-2009-112284 | A1 | 9/2009 |

OTHER PUBLICATIONS

International Search Report and Written Opinion of the International Searching Authority issued in PCT/US2018/028336, dated Jan. 7, 2019.

International Search Report and Written Opinion of the International Searching Authority issued in PCT/US2017/025399, dated Jul. 11, 2017; ISA/KR.

* cited by examiner

LIGHTWEIGHT POLYMERIC CONTAINER FINISH

CROSS REFERENCE TO RELATED APPLICATIONS

This application is a U.S. National Phase Application under 35 U.S.C. 371 of International Application No. PCT/US2017/025399 filed on Mar. 31, 2017. This application claims the benefit of U.S. Provisional Application No. 62/411,029 filed on Oct. 21, 2016. The entire disclosures of both of the above applications are incorporated herein by reference.

FIELD

The present disclosure relates to a lightweight finish for polymeric storage containers.

BACKGROUND

This section provides background information related to the present disclosure, which is not necessarily prior art.

It is common in the packaging industry to use blow molded polymeric containers made of polyethylene terephthalate (PET), polypropylene (PP), or polyethylene (PE), as well as any other suitable materials, to store food and beverage type products, such as spirits, sauces, carbonated soda, juice, water, sports drinks, and the like. Most containers have a threaded finish at the opening of the container configured to cooperate with a threaded closure or cap in order to hermetically seal the contents inside the container. In the packaging industry, lightweight containers are preferred because they are relatively less costly to manufacture and transport.

While current polymeric containers are suitable for their intended use, they are subject to improvement. The present teachings advantageously provide for improved polymeric containers having a finish portion that is relatively lighter in weight as compared to current containers. The containers according to the present teachings also advantageously maintain proper fitment with a closure to ensure that the fill product remains sealed during distribution of the container until the container is ultimately opened by the consumer. Further, the containers according to the present teaching include features that allow the containers, and preforms thereof, to be supported in a blow mold during blow molding and be handled during the filling process without having a standard support flange.

SUMMARY

This section provides a general summary of the disclosure, and is not a comprehensive disclosure of its full scope or all of its features.

The present teachings provide for a polymeric container including a base, a body, a finish, finish threads, and a tamper lip. The body extends from the base. The finish defines an opening through which a product can pass into, and out of, an internal volume of the container defined at least in part by the body. The finish threads are at an outer surface of the finish, and are configured to cooperate with closure threads of a closure to secure the closure to the finish. The tamper lip extends from the outer surface of the finish, and is configured to cooperate with a tamper tab of the closure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of select embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
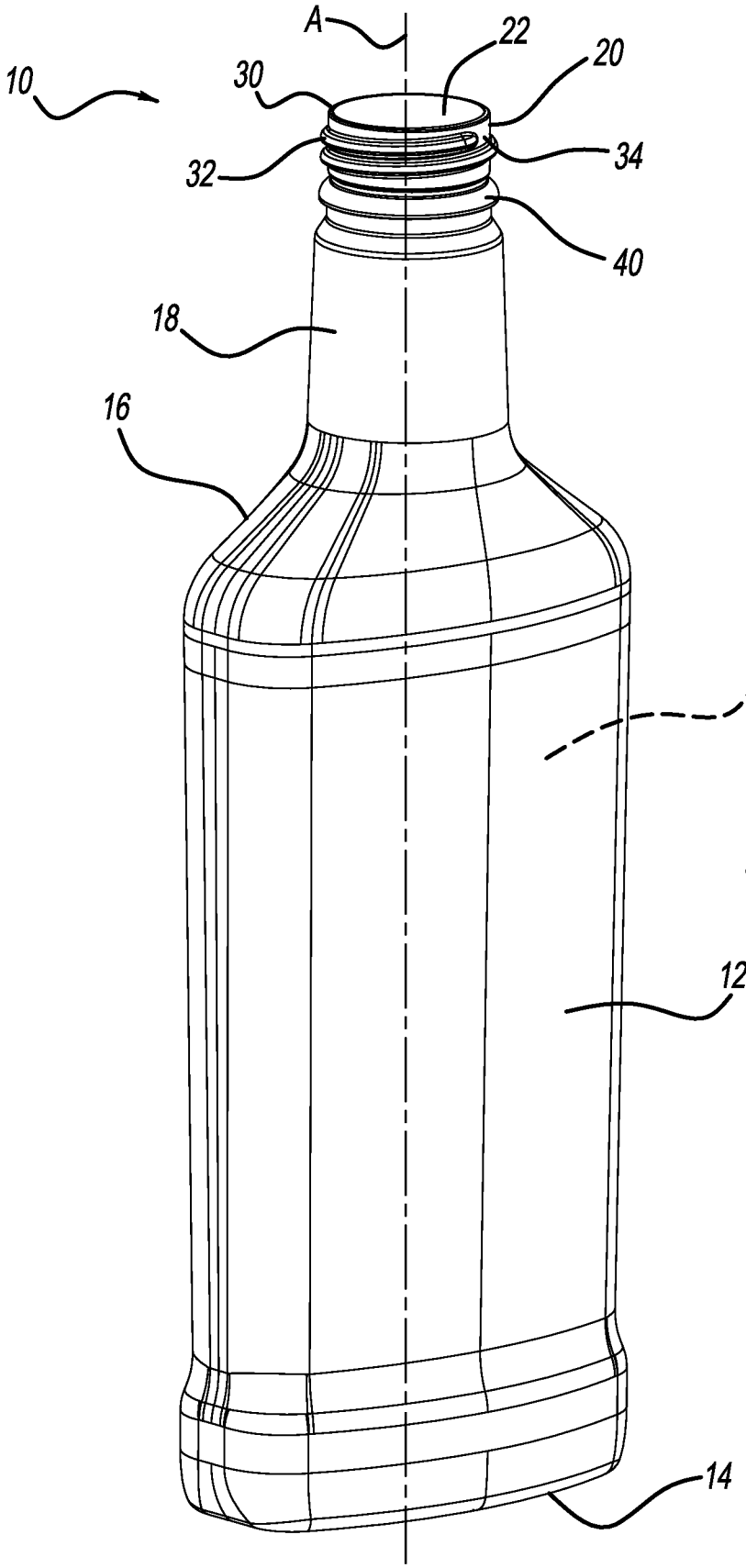
FIG. 1 is a perspective view of a container according to the present teachings.

With initial reference to FIG. 1, a container according to the present teachings is generally illustrated at reference numeral 10. The container 10 can be made of any suitable material, such as any suitable polymeric material including polyethylene terephthalate (PET), polypropylene (PP), or polyethylene (PE). The container 10 generally includes a body 12, a base 14, a shoulder 16, a neck 18, and a finish 20. The body 12 is between the base 14 and the shoulder 16. The base 14 can be any suitable container base configured to support the container 10 upright on a flat surface. The shoulder 16 extends from the body 12 to the neck 18. The neck 18 extends from the shoulder 16 to the finish 20, and thus the neck 18 is between the shoulder 16 and the finish 20. The neck 18 can have any suitable diameter $D_N$ (see FIG. 2) measured generally where the neck 18 transitions to the finish 20. One object of the invention is the diameter $D_N$ can be the same as, or similar to, an outer diameter $D_C$ of closure 60 (see FIGS. 5 and 7), which provides a smooth aesthetic transition from the closure 60 to the neck 18 of the finish 20. This is advantageous to provide a premium look to the customer.

The container 10 can be configured to store any suitable product therein, such as spirits (liquor), alcohol, carbonated soda, juice, water, sports drinks, and any suitable type of food stuffs, such as sauces. The container 10 can have any suitable shape and size. For example, the body 12, base 14, and shoulder 16, can have a generally oblong shape as illustrated. The neck 18 can be generally circular or oblong as well. The finish 20 is generally circular. The container 10 may have any other suitable shape in addition to that which is illustrated. For example, the body 12, the base 14, the shoulder 16, and the neck 18 can each be round, or generally round.

The finish 20 defines an opening 22 of the container 10. The opening 22 provides access to an internal volume 24 of the container 10. The internal volume 24 can have any suitable capacity, such as 500 ml or less than 500 ml, or greater than 500 ml such as 1 liter or 1.5 liters. The container 10 may be filled with any suitable product through the opening 22, and any product stored within the container 10 may be dispensed through the opening 22. The opening 22 provides access to the internal volume 24. A longitudinal access A of the container 10 extends through a radial center of the opening 22, and through a center of each of the neck 18, the shoulder 16, the body 12, and the base 14.

A top surface 30 of the finish 20 extends around the opening 22, and defines the opening 22 at a top end of the container 10. The top surface 30 may be smooth, or include any suitable surface features configured to reduce the weight of the finish 20, as further explained herein and illustrated in FIGS. 4A and 4B. The finish 20 includes finish threads 32 at an outer surface 34 of the finish 20. In the example illustrated, the threads 32 extend outward from the outer surface 34, but in some configurations the threads 32 may be recessed within the outer surface 34. The outer surface 34 is opposite to an inner surface 36 (FIG. 3) of the finish 20. The threads 32 are configured to cooperate with closure threads of any suitable closure, such as the threads 70 of the closure 60 of FIGS. 5 and 6 described herein.

Figure 2:
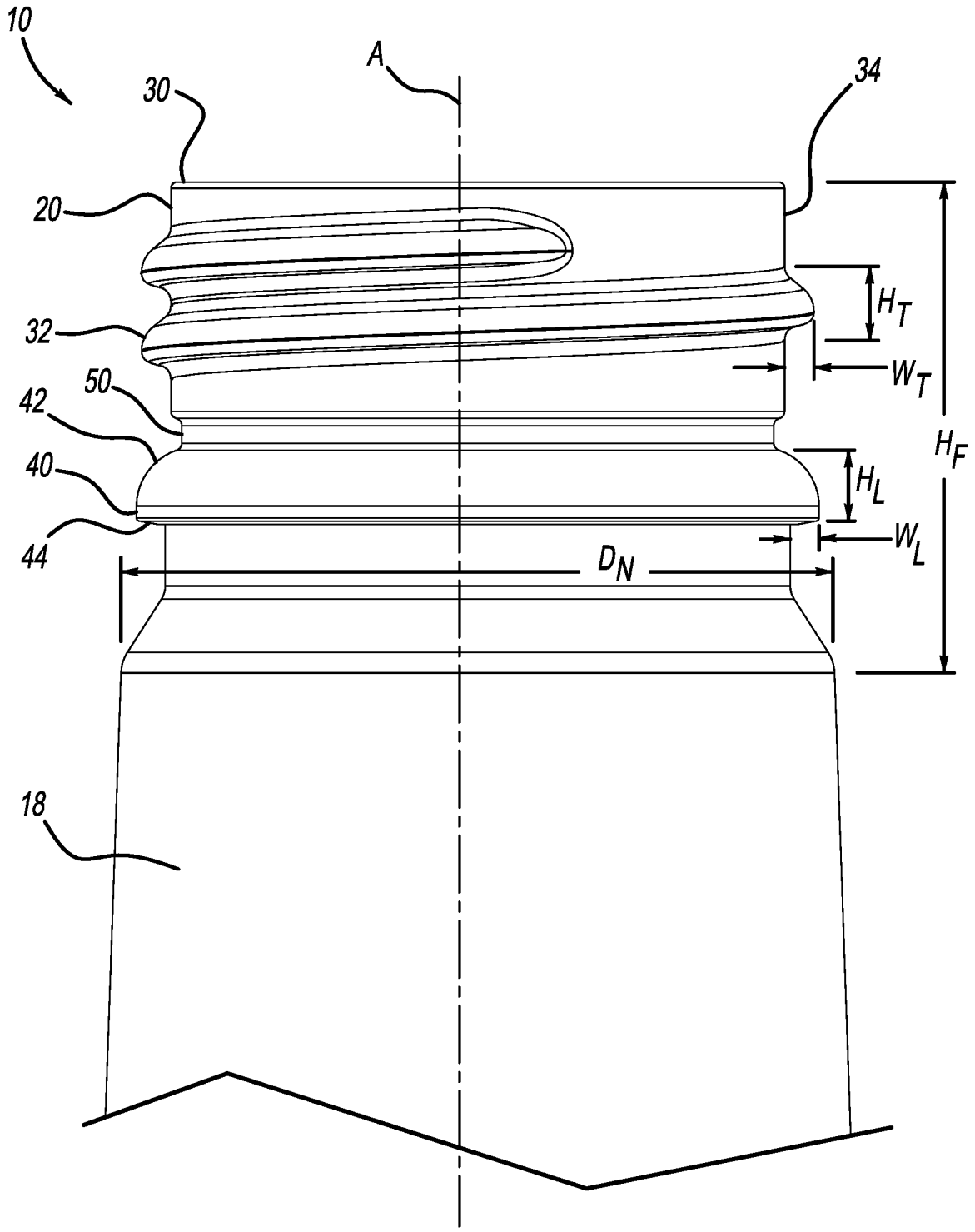
FIG. 2 is a side view of a finish portion, and part of a neck portion, of the container of FIG. 1.

With reference to FIG. 2, the finish threads 32 can have any suitable height $H_T$, such as less than 0.04 inches. The finish threads 32 can have any suitable width $W_T$ measured from the outer surface 34. For example, the threads 32 can have a width $W_T$ of less than 0.025 inches. The finish 20 has a finish height $H_F$, which extends from the top surface 30 to generally where the finish 20 and neck 18 meet. The finish height $H_F$ can be any suitable height, such as between 0.54 inches to 0.80 inches.

The finish 20 further includes a tamper lip 40. Another object of the invention is the tamper lip 40 is the only feature generally located between the threads 32 and the neck 18. The tamper lip 40 is generally circular and extends outward from the outer surface 34 of the finish 20. The tamper lip 40 is configured to engage a tamper tab of any suitable closure for the container 10, such as the tamper tab 72 of the closure 60 illustrated in FIG. 6. The tamper lip 40 can have any suitable height $H_L$ measured generally parallel to the longitudinal axis A. For example, the tamper lip 40 can have a height $H_L$ of less than 0.06 inches. The tamper lip 40 can have any suitable width measured from the outer surface 34. For example, the tamper lip 40 can have a width $W_L$ of less than 0.025 inches.

Figure 8:
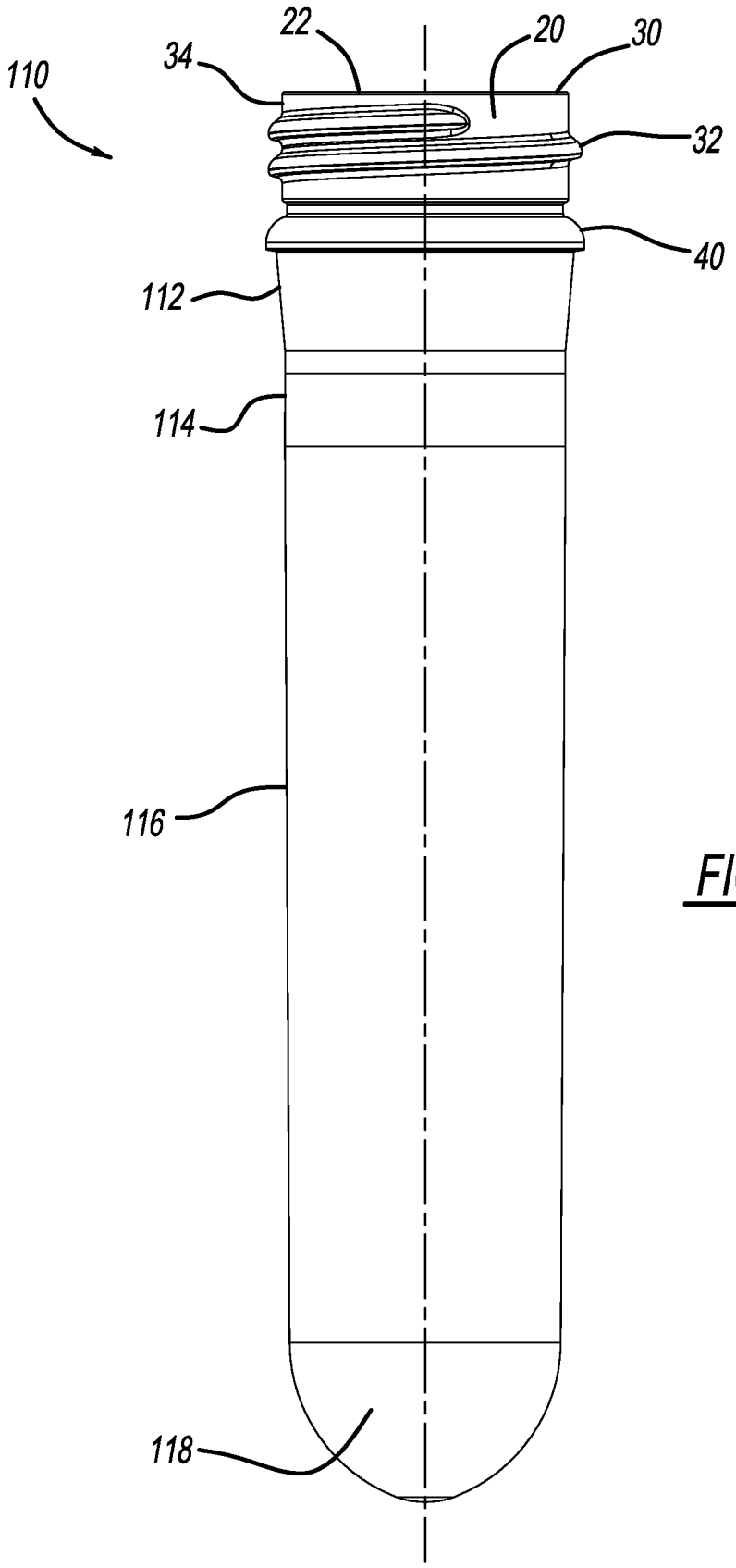
FIG. 8 is a side view of a preform according to the present teachings, from which the container of FIG. 1 can be blow molded.

The tamper lip 40 can have a generally rounded upper surface 42, and a generally planar lower surface 44. The rounded upper surface 42 extends from the outer surface 34 outward and down to the lower surface 44. The lower surface 44 extends inward from the rounded upper surface 42 back to the outer surface 34. The tamper lip 40 is advantageously configured such that during blow molding the tamper lip 40 can be engaged to support a preform, such as preform 110 of FIG. 8, for the container 10 in a mold, thereby eliminating the need for a separate support flange (not shown), which advantageously reduces the weight and height of the container 10.

Between the tamper lip 40 and the threads 32 is a gripper flange 50. The gripper flange 50 provides an area of the finish 20 that is particularly suitable for engagement by any suitable gripping or coupling device for moving the container 10/preform 110 as the container 10 is being formed.

Figure 3:
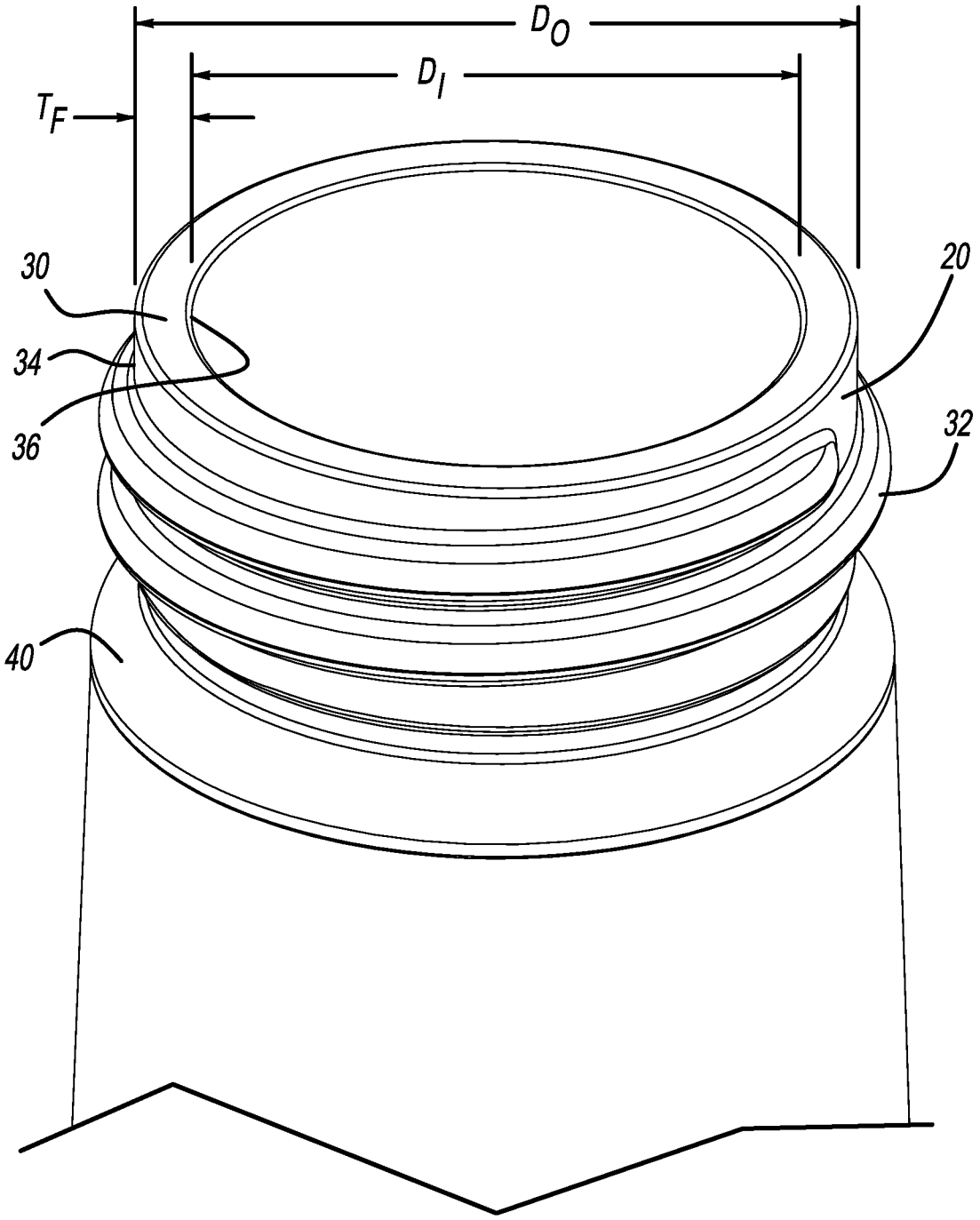
FIG. 3 is a perspective view of the finish of the container of FIG. 1.

With reference to FIG. 3, the finish 20 can have any suitable diameter for accepting industry standard closures, such as 18 mm, 22 mm, 28 mm, 33 mm, 38 mm, or 43 mm. Specifically, for example, the outer surface 34 of the finish 20 can have any suitable maximum outer diameter $D_O$, such as less than 25 mm or greater than 30 mm. The inner surface 36 of the finish 20 can have any suitable maximum inner diameter $D_I$, such as less than 22 mm. The finish 20 can have any suitable thickness or width $T_F$ between the outer surface 34 and the inner surface 36. For example, the thickness $T_F$ of the finish 20 as measured between the outer surface 34 and the inner surface 36 can be less than 0.045 inches.

Figure 4A:
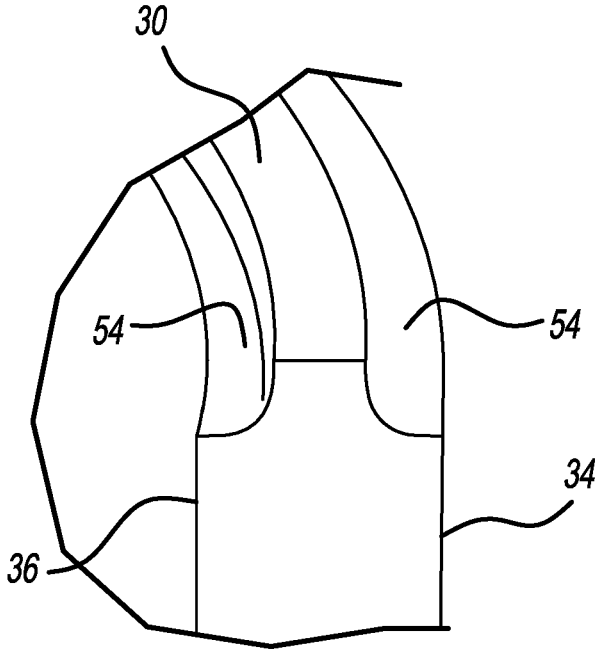
FIG. 4A illustrates a top surface of the finish of the container of FIG. 1, the top surface including rounded edges in accordance with the present teachings.
Figure 4B:
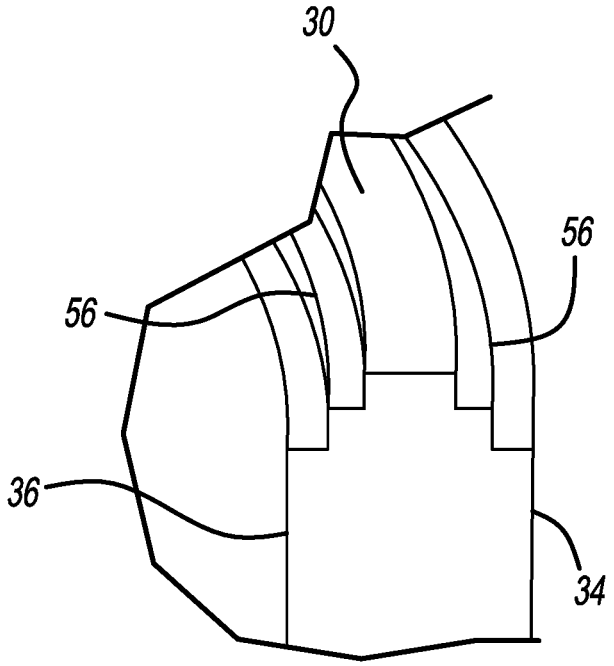
FIG. 4B illustrates a top surface of the finish of the container of FIG. 1, the top surface including stepped edges in accordance with the present teachings.

With reference to FIG. 4A, inner and outer edges of the top surface 30 can be removed at the outer and inner surfaces 34 and 36 to provide the top surface 30 with generally rounded edges 54. Due to the rounded edges, the finish 20 has less material, and is thus advantageously lighter. As illustrated in FIG. 4B, the edges 54 need not be rounded, but can rather be stepped to provide stepped edges 56, which advantageously also reduces the weight of the finish 20. Other combinations of steps and rounded edges to make the finish 20 lighter will be apparent to those skilled in the art.

Figure 5:
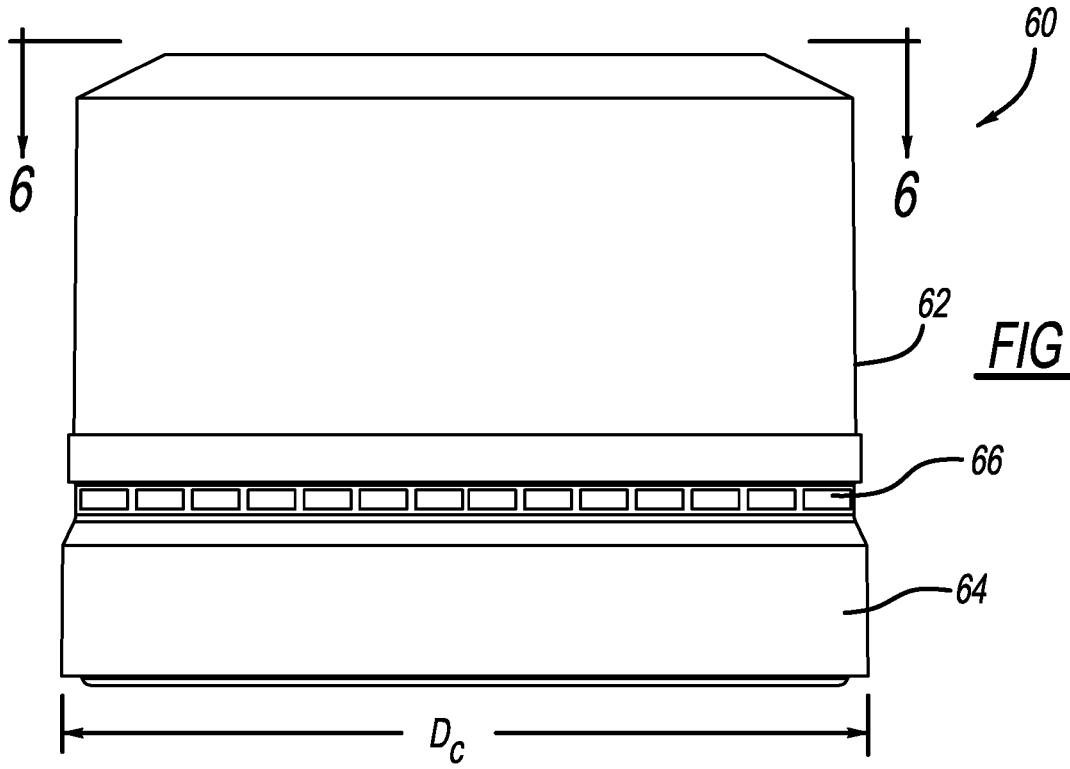
FIG. 5 is a side view of a closure according to the present teachings for closing the container of FIG. 1.
Figure 6:
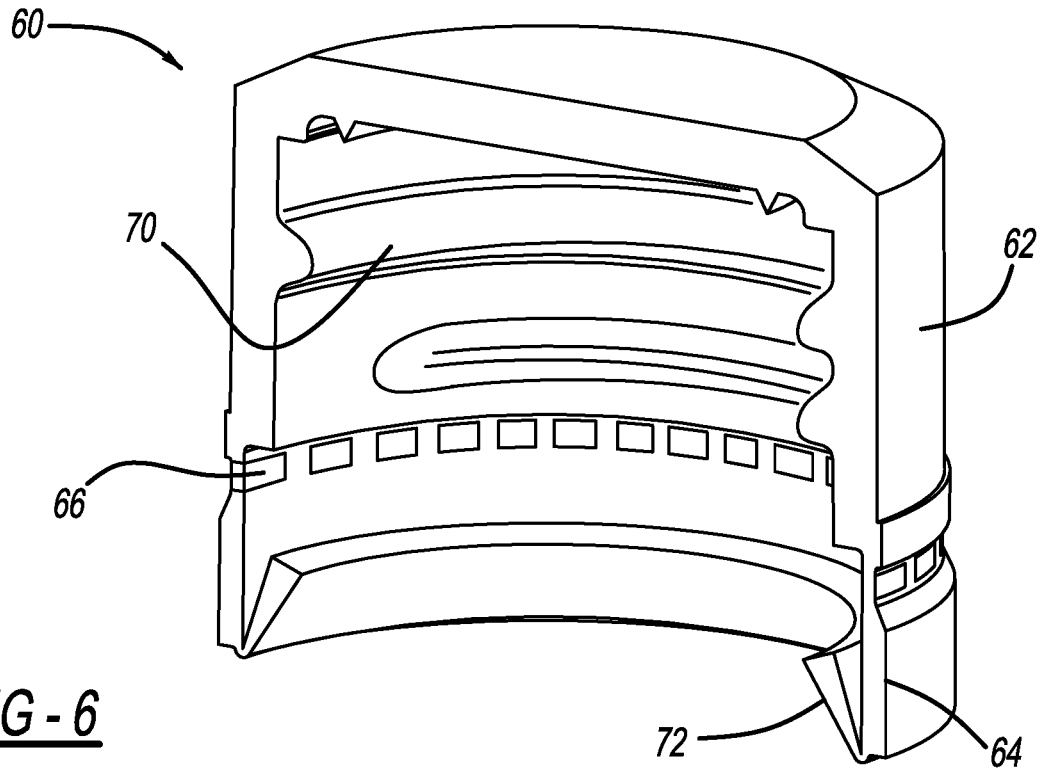
FIG. 6 is a cross-sectional view of the closure of FIG. 5 taken along line 6-6 of FIG. 5.
Figure 7:
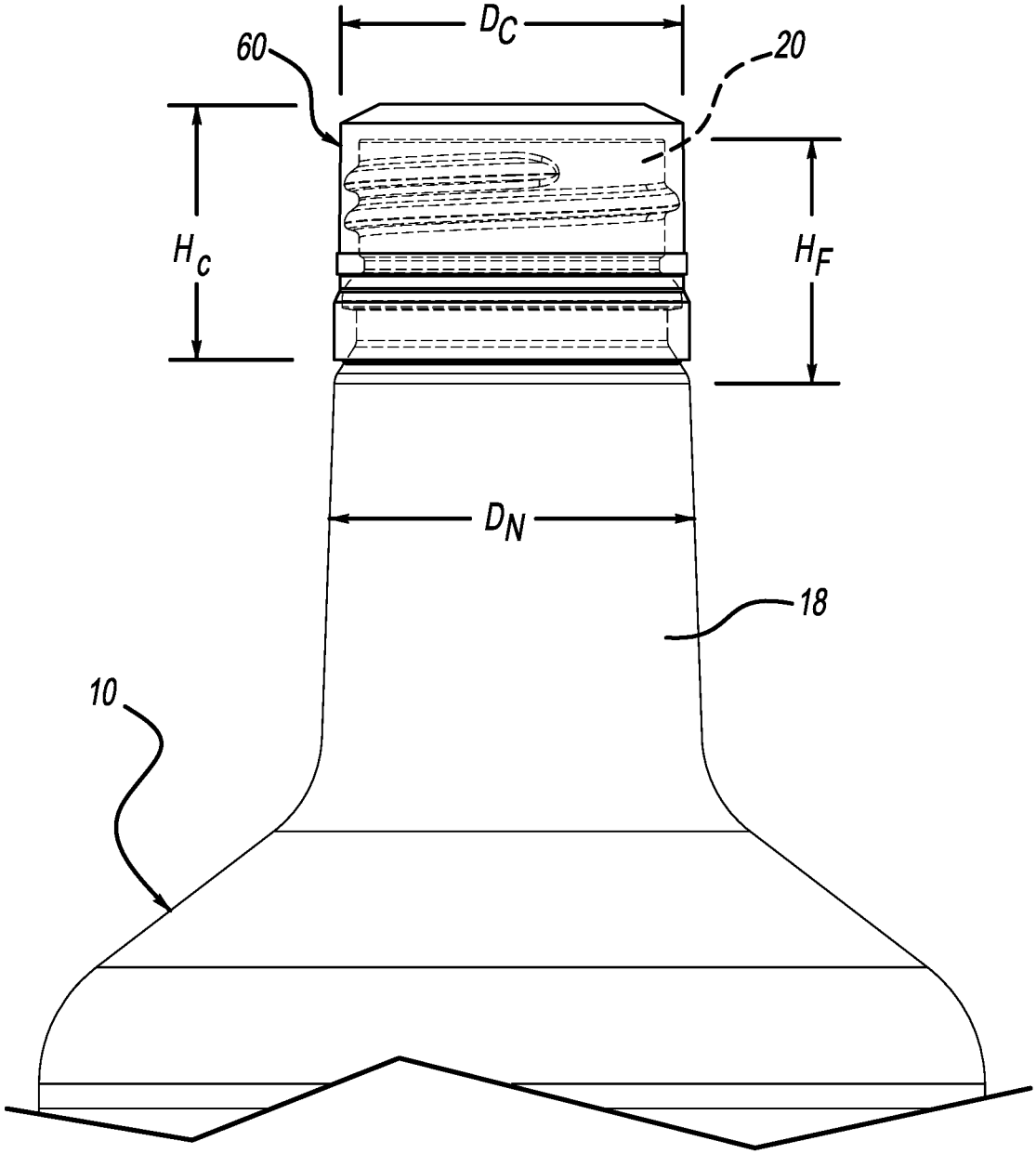
FIG. 7 illustrates the closure of FIG. 5 secured to a finish portion of the container of FIG. 1 in order to close the container.

With reference to FIGS. 5 and 6, the closure 60 will now be described in further detail. The closure 60 generally includes a main body 62, and a frangible tamper band 64, which is connected to the main body 62 at perforated area/ring 66. A tamper tab 72 extends from the frangible tamper band 64 inward into the closure 60. The tamper tab 72 is sized and shaped to pass over the tamper lip 40 of the container finish 20 when the closure 60 is being secured to the finish 20, such as through cooperation between threads 70 of the closure 60 and the threads 32 of the finish 20. The tamper tab 72 slides over the rounded upper surface 42 of the tamper lip 40 as the closure 60 is being screwed onto the finish 20. After the tamper tab 72 has passed over the rounded upper surface 42, the tamper tab 72 will flex inward towards the longitudinal axis A and abut the lower surface 44 of the tamper lip 40. There must be clearance between the bottom surface of the tamper band 64 and the neck 18 so that the neck 18 does not interfere with applying and tightening the closure 60. When the closure 60 is unscrewed and removed from the finish 20, the tamper tab 72 will remain under the tamper lip 40 and the main body 62 will separate from the frangible tamper band 64 at the perforated ring 66. Separation of the main body 62 from the frangible tamper band 64 advantageously provides a visual indication that the closure 60 has been removed from the finish 20. FIG. 7 illustrates the closure 60 secured to the finish 20 of the container 10. The overall closure height Hc can be any suitable height, such as between 0.54 inches to 0.80 inches.

The container 10 can be manufactured in any suitable manner. For example, the container 10 can be blow molded from any suitable preform, such as the preform 110 of FIG. 8. The preform 110 itself can be formed in any suitable manner, such as by injection molding. The preform 110 includes the finish 20, which defines the opening 22 and includes the threads 32 and the tamper lip 40. Extending from the finish 20 is a neck portion 112, a body portion 116, and a base portion 118. After injection blow molding of the preform 110, the neck portion 112 forms the neck 18, the shoulder portion 114 forms the shoulder 16, the body portion 116 forms the body 12, and the base portion 118 forms the base 14.

The finish 20 can optionally include a support flange (not shown) between the tamper lip 40 and the neck 18. The support flange extends around the finish 20 and outward from the finish 20. The support flange can advantageously be used to support the container 10 as it is being injection blow molded. The support flange can have any suitable maximum outer diameter, such as less than 22 mm. The support flange can have any suitable width as measured from the inner surface 36 of the finish 20, such as less than 0.2 inches. The support flange can have any suitable height, such as less than 0.05 inches.

Figure 9:
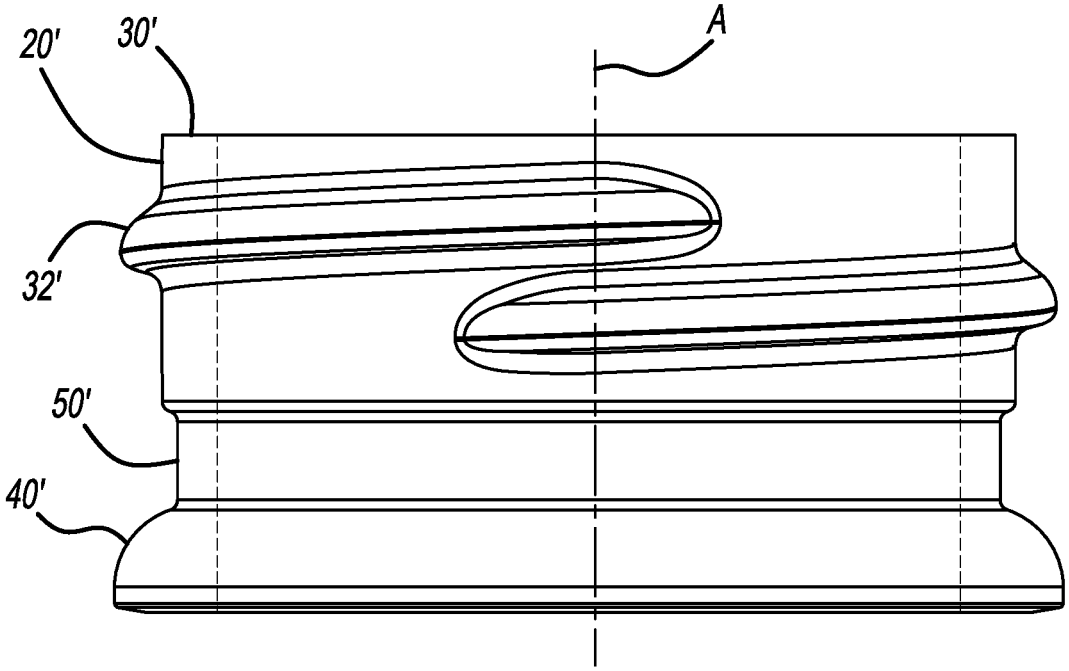
FIG. 9 is a side view of another finish according to the present teachings.
Figure 10:
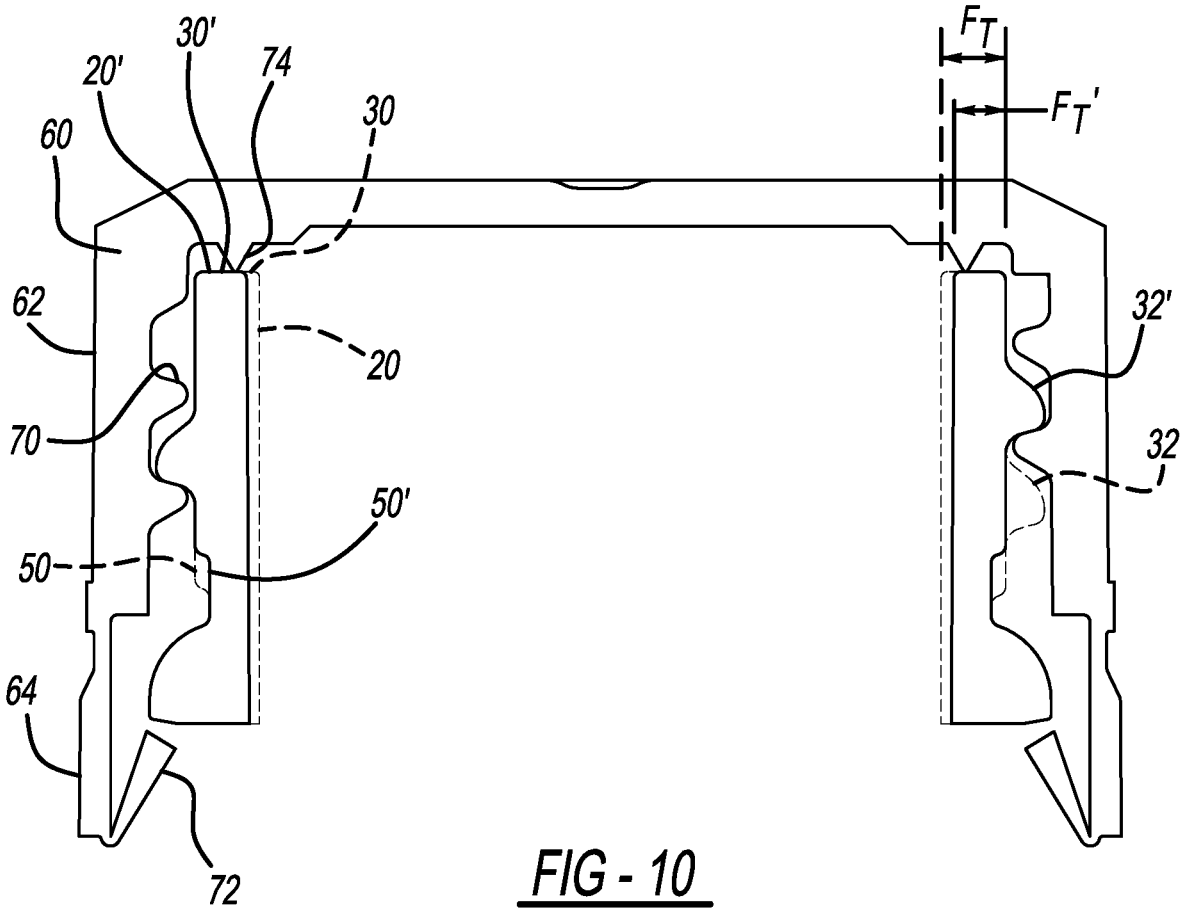
FIG. 10 is a cross-sectional view of the finish of FIG. 9 with the closure of FIGS. 5 and 6 coupled thereto.

With reference to FIGS. 9 and 10, an additional finish 20' in accordance with the present teachings is illustrated. The finish 20' is similar to the finish 20, except for the following differences which make the finish 20' advantageously lighter. Specifically, threads 32' are shorter than the threads 32 in that each one of the threads 32' make only one complete turn around the finish 20'. This is in contrast to the threads 32, which each make 1.5 turns around the finish 20. By making the threads 32' shorter, the threads 32' can be moved upward closer to the top surface 30', and gripper flange 50' can be made taller. Specifically, the gripper flange 50' extends further along a direction parallel to the longitudinal access A, as compared to the gripper flange 50. The gripper flange 50' can be more easily engaged by a suitable gripping or coupling device for moving the finish 20' during manufacturing.

With particular reference to FIG. 10 the finish 20' has a thickness $F_T'$ that is thinner than the finish thickness $F_T$ of the finish 20. The finish thickness $F_T'$ of the finish 20' is generally 0.015 inches thinner than the finish thickness $F_T$ of the finish 20, which makes the finish 20' about 0.648 grams lighter than the finish 20 (when the container 10 is made of PET). Making the finish 20' thinner and lighter advantageously reduces the manufacturing and shipping cost of the container 10. Because the finish 20' has a finish thickness $F_T'$ that is thinner than the finish thickness $F_T$ of the finish 20, a crush bead 74 of the closure 60 will be arranged closer to the inside diameter of the finish 20' as compared to the finish 20 when the closure 60 is secured to the respective finishes 20/20'.

The finish thickness $F_T$ of the finish 20 can be 3.94 mm, or about 3.94 mm. The gripper flange 50 can have a height of 0.71 mm, or about 0.71 mm. The finish thickness $F_T'$ of the finish 20' can have a thickness of 3.14 mm, or about 3.14 mm. The height of the gripper flange 50' can be 2.3 mm, or about 2.3 mm.

The present teachings advantageously provide for reducing the weight of the finish 20, as well as the height of the finish 20, to provide the container 10 with a height to center of gravity ratio that is greater than 0.025, or less than 0.499. The finish 20 can have any suitable weight, such as greater than 2.3 grams, or less than 2.5 grams. The finish 20 according to the present teachings has a weight that is advantageously about 35% less than, to about 44% less than, the weight of an industry standard finish for accepting the same size of closure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A polymeric container comprising;

a base;

a body extending from the base;

a finish defining an opening through which a product can pass into, and out of, an internal volume of the container defined at least in part by the body;

finish threads at an outer surface of the finish that are configured to cooperate with closure threads of a closure to secure the closure to the finish, the finish is devoid of a support flange; and a tamper lip extending from the outer surface of the finish, the tamper lip configured to cooperate with a tamper tab of the closure, during blow molding of the polymeric container from a preform the preform is supported by the tamper lip;

wherein each one of the finish threads extends only 1.5 times around the finish.

2. The polymeric container of claim 1, further comprising a shoulder extending from the body, and a neck extending from the shoulder to the finish.

3. The polymeric container of claim 1, wherein the container is made of polyethylene terephthalate (PET), polypropylene (PP), or polyethylene (PE).

4. The polymeric container of claim 1, wherein the finish includes a top surface at a top end of the container opposite to the base, the top surface defining the opening at the top end.

5. The polymeric container of claim 4, wherein the top surface is smooth about an entire circumference of the finish.

6. The polymeric container of claim 4, wherein the top surface includes at least one rounded edge.

7. The polymeric container of claim 4, wherein the top surface includes at least one stepped edge.

8. The polymeric container of claim 1, wherein the container is blow molded from a preform, and the preform is injection molded.

9. The polymeric container of claim 1, wherein the finish has an outer finish diameter that is proximate to, or the same as, an outer neck diameter of a neck of the polymeric container at an interface between the neck and the finish.

10. The polymeric container of claim 1, wherein the finish weighs more than 2.3 g or less than 2.5 g.

11. The polymeric container of claim 1, wherein the tamper lip has a width of less than 0.025" as measured from an outer surface of the finish.

12. The polymeric container of claim 1, wherein the tamper lip has a height of less than 0.06".

13. The polymeric container of claim 1, wherein the finish threads have a width of less than 0.025" as measured from an outer surface of the finish.

14. The polymeric container of claim 1, wherein the finish threads have a height of less than 0.04".

15. The polymeric container of claim 1, wherein the finish has a height of between 0.54" and 0.80".

16. A polymeric container comprising;

a base;

a body extending from the base;

a finish defining an opening through which a product can pass into, and out of, an internal volume of the container defined at least in part by the body;

finish threads at an outer surface of the finish that are configured to cooperate with closure threads of a closure to secure the closure to the finish, the finish is devoid of a support flange; and a tamper lip extending from the outer surface of the finish, the tamper lip configured to cooperate with a tamper tab of the closure, during blow molding of the polymeric container from a preform the preform is supported by the tamper lip;

wherein the finish further includes a gripper flange having a height of 0.71 mm.

17. A polymeric container comprising;

a base;

a body extending from the base;

a finish defining an opening through which a product can pass into, and out of, an internal volume of the container defined at least in part by the body;

finish threads at an outer surface of the finish that are configured to cooperate with closure threads of a closure to secure the closure to the finish, the finish is devoid of a support flange; and a tamper lip extending from the outer surface of the finish, the tamper lip configured to cooperate with a tamper tab of the closure, during blow molding of the polymeric container from a preform the preform is supported by the tamper lip;

wherein the finish further includes a gripper flange having a height of 2.3 mm.

* * * * *